United States Patent [19]

Karlsson

[11] 4,016,024

[45] Apr. 5, 1977

[54] MACHINE TO ARRANGE A NOISE INSULATION BETWEEN TWO CONCRETE ELEMENTS

[75] Inventor: Lars-Erik Karlsson, Kallered, Sweden

[73] Assignee: Nilcon Engineering AB, Kallered, Sweden

[22] Filed: Dec. 10, 1974

[21] Appl. No.: 531,224

[30] Foreign Application Priority Data

Dec. 14, 1973 Sweden ..... 7316899
Oct. 21, 1974 Sweden ..... 7413207

[52] U.S. Cl. ..... 156/378; 52/126; 52/731; 156/510; 156/517; 156/556; 156/578; 156/598

[51] Int. Cl.[2] ..... B32B 31/12; G01B 5/14

[58] Field of Search ..... 156/510, 556, 578, 598, 156/152, 517, 378, 538, 539, 65, 99, 560; 52/723, 731, 383, 126, 124, 122, 730

[56] References Cited

UNITED STATES PATENTS

| | | | |
|---|---|---|---|
| 3,274,662 | 9/1966 | Jackman et al. | 156/556 |
| 3,278,158 | 10/1966 | Saldana | 52/126 |
| 3,327,997 | 6/1967 | Zenke | 52/126 |
| 3,531,354 | 9/1970 | Hetzinger et al. | 156/556 |

*Primary Examiner*—Charles E. Van Horn
*Assistant Examiner*—M. G. Wityshyn
*Attorney, Agent, or Firm*—Harness, Dickey & Pierce

[57] ABSTRACT

A machine of introducing sound-insulating members of a resilient material at predetermined places in concrete beams formed by a lower concrete element, preferably coffer-shaped, and an upper concrete element in the form of a slab. The machine comprises means to raise the upper element from the lower element so as to form therebetween a gap intended to receive the sound-insulating members, means to sense the vertical dimensions of said gap, means to cut off a piece of insulating material the vertical dimensions of which agree with those of the gap, means to apply an adhesive to said member, and means to position said member in the gap in the predetermined position. The invention ensures that the total thickness of concrete beams including such a sound-insulating layer is equal for all beams thus composed irrespective of the individual thickness of the discrete concrete elements. Within the principles of the present invention the machine may operate in a fully automated way or be designed as a manually operated machine.

15 Claims, 19 Drawing Figures

51a
51
39
44
43
56
55
53
54
69
41
101
66
52
69
70
71
72
73
67
74
77
75
76
78
29
68

79
82
81
67
101
106
105
107
74
66 (69)
108

MACHINE TO ARRANGE A NOISE INSULATION BETWEEN TWO CONCRETE ELEMENTS

BACKGROUND OF THE INVENTION

It is known to manufacture the joists and other supporting structures in buildings in the form of light concrete beams arranged adjacent one another and each one consisting of an elongate concrete coffer closed by a concrete slab with some sound-insulating material inserted in the gap between the slab and the coffer. One has found that sound-insulating means consisting of equidistantly positioned blocks of rubber or other suitable resilient material arranged in gap between the slab and the coffer give a satisfactory sound-insulating effect while at the same time offering the possibility of providing an air passage between neighbouring beams.

SUMMARY OF THE INVENTION

The present invention concerns a method of inserting in an expedient and exact manner such blocks of a resilient material into the gap between the slab and the coffer while at the same time ensuring that the total thickness of the two concrete elements and the noise insulating layers will be the same for all the beams thus composed, even when the individual thickness of the various concrete elements differs. The invention is characterized by the following operational steps:

lifting the slab off the coffer against a number of abutments whereby intermediate the two concrete elements a gap is formed having a height which by a certain value, e.g. 10 millimeters, exceeds the height of the intended layer of insulating material, inserting into said gap a sensing device by means of which a stand attached to said device is set at the correct working level, feeding a rod-shaped blank of the resilient material down against a stop abutment which depends on the height of the gap, seizing the lower end of the rod blank by means of a gripping device, severing transversely from the lower end of the rod blank a portion of the rod the height of which depends on the height of the gap, swinging the gripping device outwards, closer to the gap, coating the severed rod piece with an adhesive at the downwardly facing and/or upwardly facing surface thereof, removing the sensing device from the gap and inserting the resilient piece into said gap with the aid of the gripping device which, having deposited said piece in the gap, returns to its original position, repeating the process and positioning resilient pieces equistantly in the gap along the entire length of the coffer, and lowering the slab into a position wherein it is supported on the resilient pieces.

The invention likewise concerns a machine to perform the method outlined above, said machine comprising both a bed supporting the coffer and the slab, and a number of lifting means to raise the slab into contact with a number of abutment means such that between the slab and the coffer a gap is formed having a height which by a certain value, e.g. 10 millimeters, exceeds the height of the sound-insulating layer to be applied in the gap. The machine in accordance with the invention is characterised by a stand moveable upwards and downwards on a carriage which is displaceable along the concrete elements, said stand comprising a device insertable into the gap to sense the height of the gap, and to set the stand vertically in dependence on the height of the gap, a device for feeding a rod-shaped blank of rubber or similar resilient material downwards against a stop abutment in dependence on the vertical position of the setting device, a device to sever a piece from the lower end of the rod-shaped blank, the height of said piece becoming dependent on the height of the gap, a device arranged to grip the severed piece and carry it outwards towards the gap, and a device arranged to apply an adhesive to the severed piece on the upwards facing and/or downwards facing surface of said piece, in addition to which the gripping device is arranged to insert the thus prepared resilient piece into said gap.

With a machine of this kind it is possible to position the resilient pieces equidistantly in the slit in a completely automated manner.

The invention also concerns a simple, manually operated machine. This machine comprises a stand which is displaceable upwards and downwards on a support frame and which is provided with a device insertable from the side into the gap intermediate the two concrete elements to sense the height of the gap and set the stand, and in addition a stop abutment thereon, vertically dependent on the height of the gap, a device for advancement of the rod-shaped blank against the stop abutment, and a device for severing a piece from one end of the rod blank, the height of said piece becoming dependent on the height of the gap.

It is characteristic of this manually operated machine in accordance with the invention that the support frame is provided with a vertical cylinder holding the rod-shaped blank, the upper end of said cylinder positioned below the stop abutment of the stand and having an operative piston by means of which the rod-shaped blank may be pushed upwards against the stop abutment. A machine of this kind may be carried in a convenient manner along the concrete element in question and at equidistantly positioned points measure the height of the gap between the slab and the coffer and cut off pieces from the rod-shaped blank, the height of said pieces corresponding to the height of the gap at the individual points of measure. After application of an adhesive to the severed pieces, the latter are arranged at the points where the measures have been taken.

BRIEF DESCRIPTION OF THE DRAWINGS

Further characteristics of the invention and advantages obtained thereby will become apparent upon reading of the following detailed description with reference to the accompanying drawings. In the drawings.

DETAILED DESCRIPTION OF A PREFERRED EMBODIMENT

Figure 1:
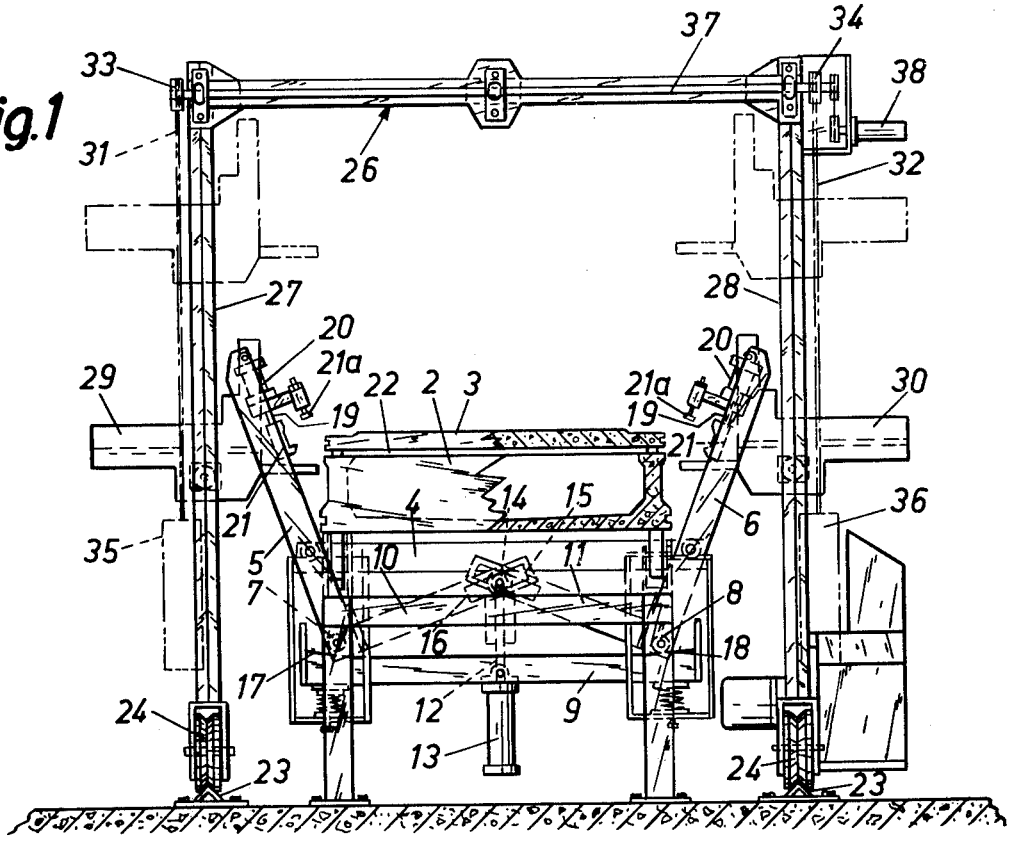
FIG. 1 illustrates a partly transverse sectional diagrammatical end view of a machine in accordance with the invention.
Figure 2:
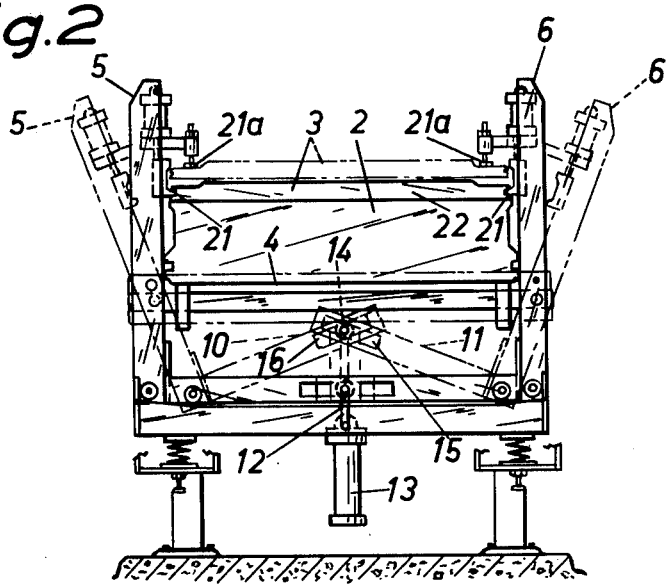
FIG. 2 is an end view of the bed incorporated in the machine to support the concrete elements between which a sound-insulating means is to be inserted.

The machine in accordance with FIGS. 1 to 12 comprises a roller conveyor 1 for advancement of an elongate concrete coffer 2 and an elongate concrete slab 3 resting thereon, to a working position above a bed. The latter consists of a number of equidistantly spaced horizontal support beams 4 the ends of which are articulated to levers 5, 6 having their lower ends resting on a horizontal beam 9 via one roller 7, 8 each and mutually interconnected via one inwardly directed arm 10, 11 each by means of a horizontal pin 14 arranged at the upper end of the piston rod 12 of a vertically arranged cylinder 13, said pin 14 passing through elongate grooves 15, 16 formed in the arms 10, 11. The beams 9 are provided at their upper surface adjacent the ends with areas 17, 18 inclining upwards/outwards and on which the rollers 7, 8 are arranged to slide upon swinging motion of the arms 5, 10, and 6, 11 in the clockwise or the anti-clockwise directions upon actuation of the piston-and-cylinder unit 12, 13. Each arm 5, 6 supports at its upper end a piston-and-cylinder unit 19, 20 by means of which a lifting means 21 may be raised or lowered. The lifting means 21 may raise the slab 3 away from the coffer 2, allowing a gap 22 to be formed between the concrete elements. The raising movement of the slab is limited by an abutment means 21*a* formed on the levers 5, 6.

The machine likewise comprises a carriage 25 which is movable on rails 23 along the roller conveyor 1 on wheels 24 and which is provided with a bridge-like support frame 26 on the vertical pillars 27, 28 on which machine stands 29 and 30 are arranged for raising and lowering motion. Each stand 29, 30 is balanced by a counter-weight 35, 36 via a roller chain 31, 32 running over pulleys 33, 34. These pulleys 33, 34 are arranged at the ends of a horizontal shaft 37 which is driven momentarily by a motor 38.

Each machine stand 29, 30 supports the following main components:

a. A device 39 for sensing the height of the slit 22 between the coffer 2 and the slab 3, and also for setting the correct height (working position) of the associated machine stand 29 or 30,
b. one means 42 for application of an adhesive on the upper end surface and/or lower end surface of the resilient piece,
c. one means 40 for severing from a rod-shaped blank of rubber or similar resilient material, pieces intended to form a sound-insulating means in the gap 22 between the coffer 2 and the slab 3, and
d. one means 41 for insertion into the gap 22 of the adhesive-treated resilient piece.

SENSING AND VERTICAL LEVEL SETTING DEVICE 39

Figure 7:
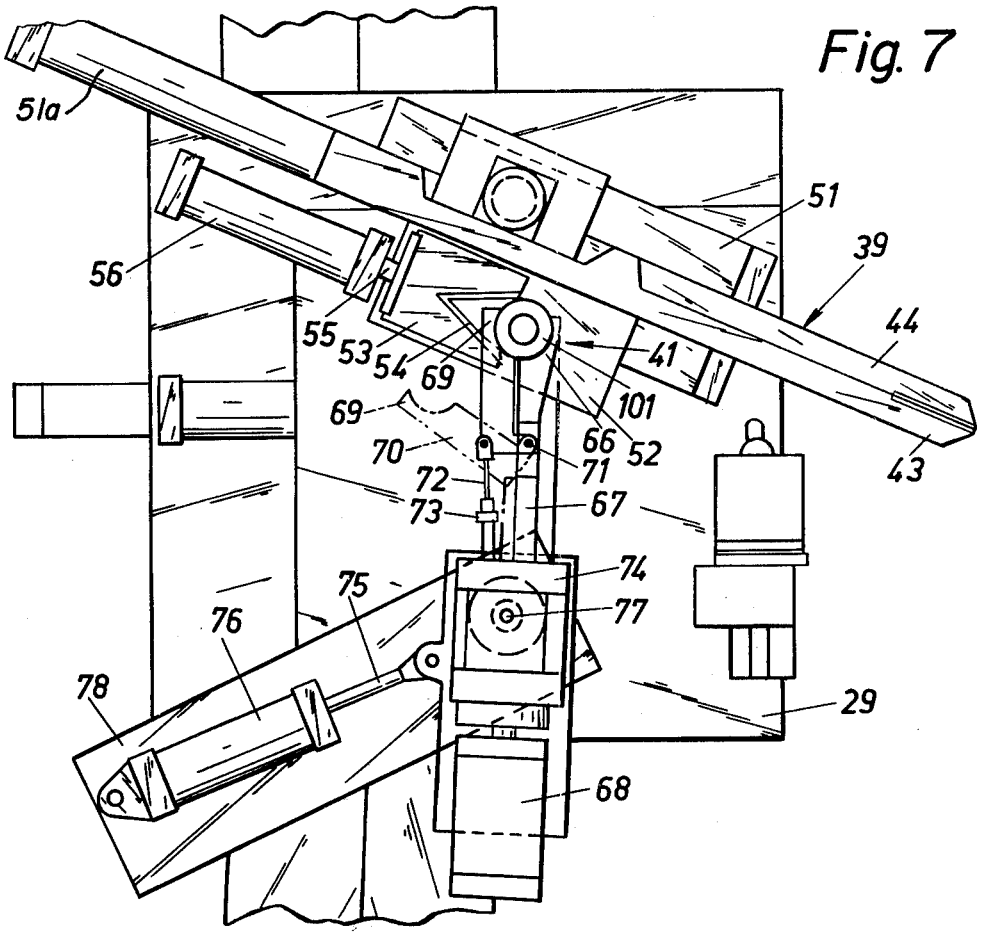
FIG. 7 is a similar plan view showing the gripping means in its inner position.
Figure 10:
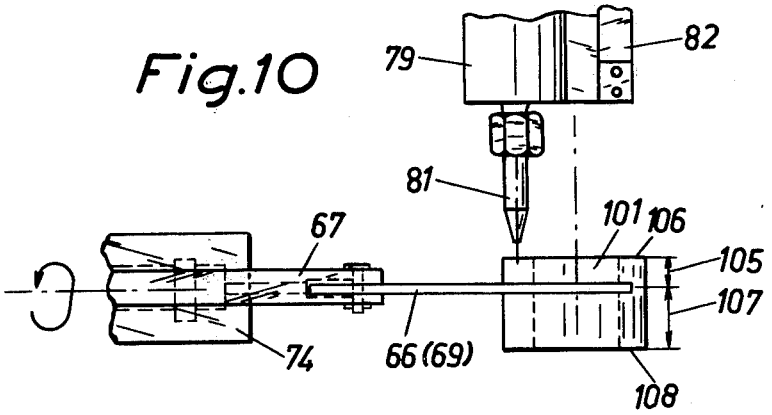
FIG. 10 is a side view of the means to apply an adhesive to one end surface of a severed resilient piece.

The device consists of two horizontal leg sections 43 and 44, leg section 43 being ridigly connected to the stand 29, 30 whereas leg section 44 is vertically displaceable on rollers 45 along a guide rail 46 provided on the stand. The leg section 44 is provided with a laterally directed arm 47 which is connected to the piston rod 48 of a working cylinder 49 secured on the stands 29, 30. The guide rail 46 is supported by a slide 51 movable on a roller bed 50 by means of a piston-and-cylinder unit 51*a* (FIG. 7).

SEVERING DEVICE 40

Figure 9:
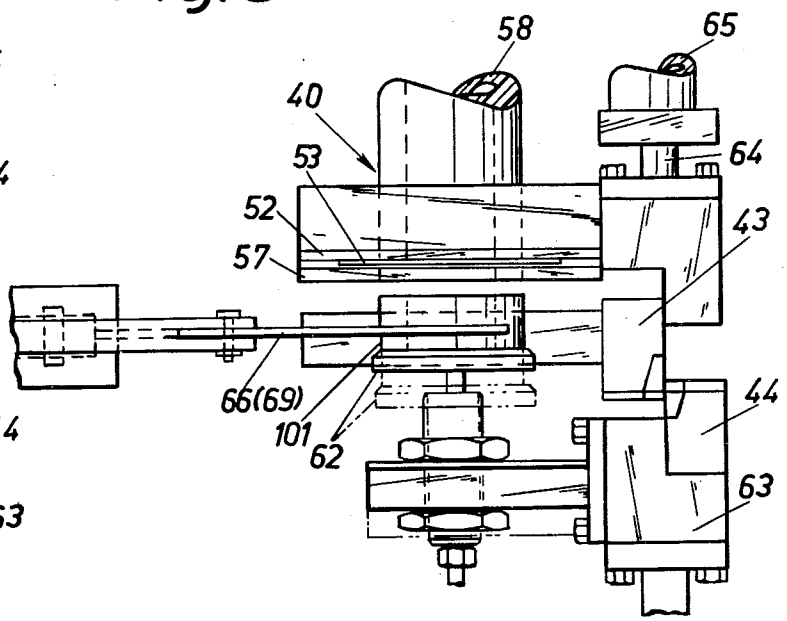
FIG. 9 is a similar view illustrating the severing means in raised position.
Figure 8:
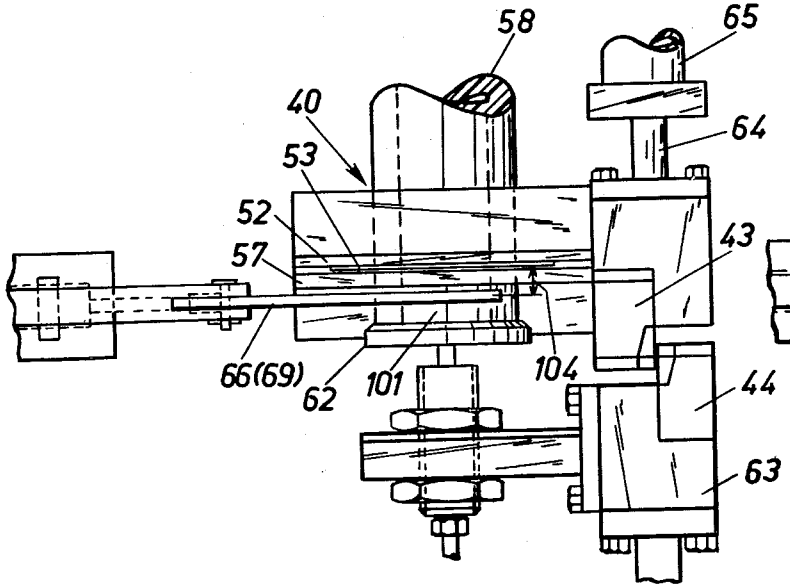
FIG. 8 is a side view of the severing means and the gripping means in its inner position.

The severing device consists of a knife 53 (FIG. 7) which has a V-shaped edge 54 and is horizontally displaceable in a head 52. The knife 53 is attached to the outer end of the piston 55 of a horizontally disposed cylinder 56. Ahead of the knife 53 and below the plane thereof is positioned a guide means 57 intended to guide a tube-shaped rod blank 58 of rubber which by means of two concave rollers 59, 60 (FIG. 6) driven by a motor 61, is forwarded sufficiently to allow its lower end to abut against a stop abutment 62 (FIGS. 8, 9). The stop abutment is supported by a holder 63 provided on the movable leg section 44 and thus is dependent on the vertical setting of this leg section. The head 52 together with the knife 53, the cylinder 56, and the guide means 57 may be raised by means of a piston-and-cylinder unit 64, 65 over a distance that must be at least equal to the height of the guide means 57.

GRIPPING DEVICE 41

The gripping means incorporates a claw element 66 which is provided at the outer end of a horizontal arm 67, and a motor 68 is provided to turn said horizontal arm over half a revolution in both directions. The claw 66 cooperates with a claw 69 provided on the outer end of an arm 70 the inner end of which is arranged for swinging motion towards and away from the claw 66 about a vertical pin 71 by means of a piston-and-cylinder unit 72, 73. The arms 67, 70 are rotatably mounted on a common shaft in a head 74 which by means of a piston-cylinder unit 75, 76 may be swung about a vertical shaft 77 in a horizontal plane on a slide 78, the latter being displaceable to and fro on the stand 29, 30 by means of a piston-and-cylinder unit, not illustrated in the drawings.

ADHESIVE APPLICATOR DEVICE 42

A spray gun 79 the upper end of which is connected to a glue container (not shown) via a hose 80 and the lower end of which is provided with a nozzle 81, is supported by a holder 82 which may be displaced by a rotator 83 in a manner permitting the nozzle 81 to describe a circular arc path in a horizontal plane. The rotator 83 is arranged at the lower end of a slide 84 having a piston-and-cylinder unit (not shown) to displace the holder 82 together with the spray gun 79 and the rotator 83 vertically over a small distance. The slide 84 is vertically displaceable downwards in a holder 86 by means of a piston-and-cylinder unit 85 from an upper position limited by a stop abutment means 87. The holder 86 is provided with a laterally extending arm 88 the outer end of which is articulated to a rod 89, the lower end of the latter being in turn articulated to one end of a two-arm lever 90. The lever is pivotally mounted about a horizontal shaft 91 on a stand upright member 92 while its opposite arm is provided with a roller 93 located in the path of movement of the arm 47.

On the stand 29, 30 (see FIG. 4), at the front thereof, is mounted a holder 94 securing a spring-loaded damping means 95 to limit the stand in its lower position (operative position), and the pillars 27, 28 of the support frame 26 are provided with a similar damping means 96 to limit the movement of the machine stand 29, 30 in its upper end position. In order to retain the machine stands 29, 30 in the operative position thereof they are provided with one clamping means 99 each, said clamping means being arranged to be pressed against the associated support frame pillar 27 or 28 and displaceable by means of a piston-and-cylinder unit 97, 98.

The machine described above operates in the following manner. A coffer 2 with a slab 3 resting thereof is advanced on a roller conveyor 1 to the position illustrated in FIG. 3 wherein the levers 5 and 6 are swung away, as shown in FIG. 1, and the raising means 21 are in their lower positions. By means of the piston-and-cylinder unit 12, 13 the levers 5, 6 are then swung towards one another and as a result of the rollers 7, 8 moving up the sloping planes 17, 18, the support beams 4 will raise the coffer 2 somewhat away from the roller conveyor. The piston-and-cylinder unit 19, 20 lifts the slab 3 with the aid of means 21, these means engaging below the longitudinal edges of the slab 3 projecting beyond the coffer, whereby a gap 22 is formed between the coffer 2 and the slab 3. The height of this gap is chosen such that it exceeds by a certain value, e.g. by 10 millimeters, the height 100 of the resilient piece 101 (FIG. 12) intended to be inserted into the gap.

Figure 4:
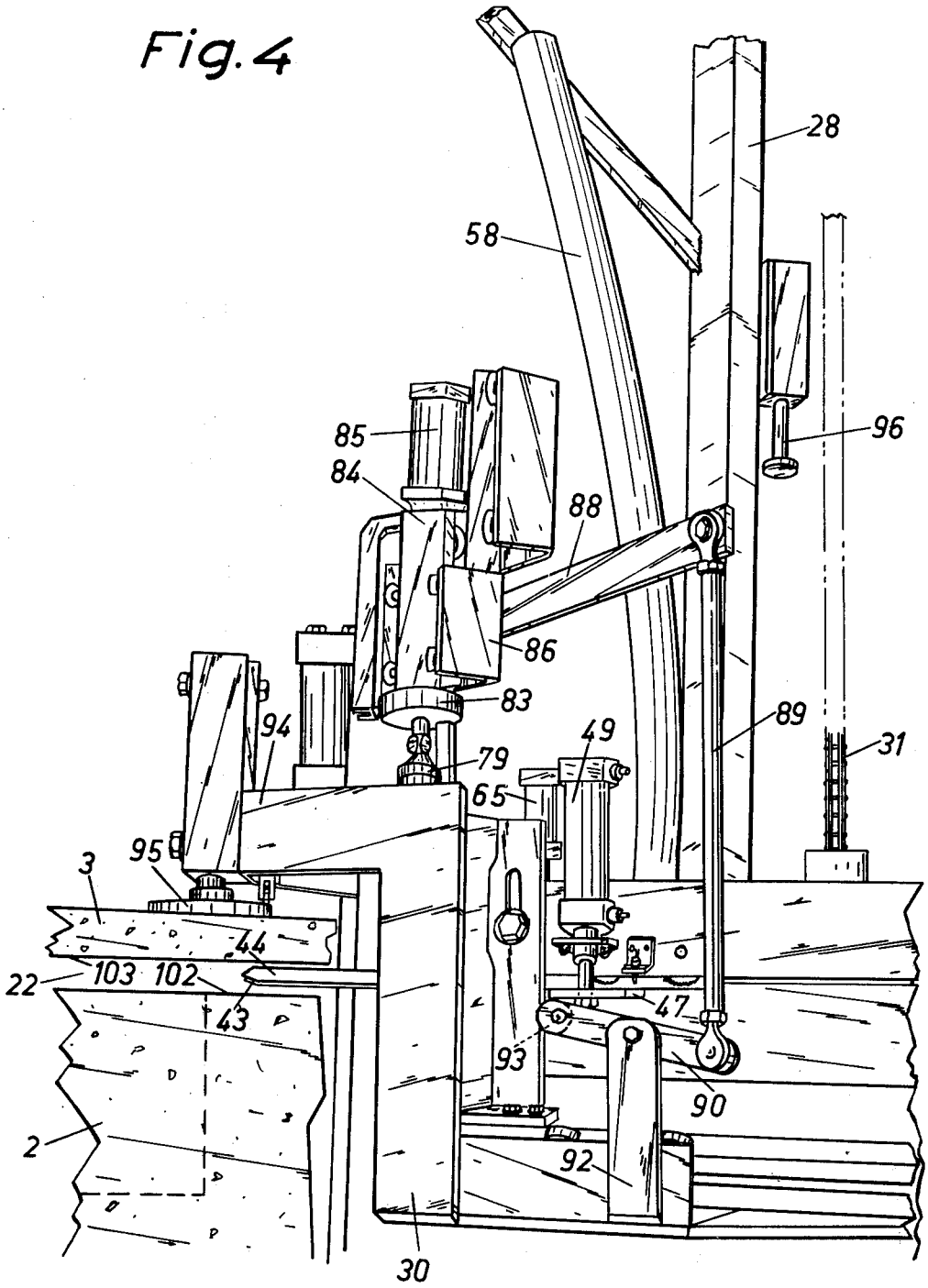
FIG. 4 is a perspective view which on a somewhat enlarged scale illustrates the right-hand part of the machine in accordance with FIG. 1.
Figure 5:
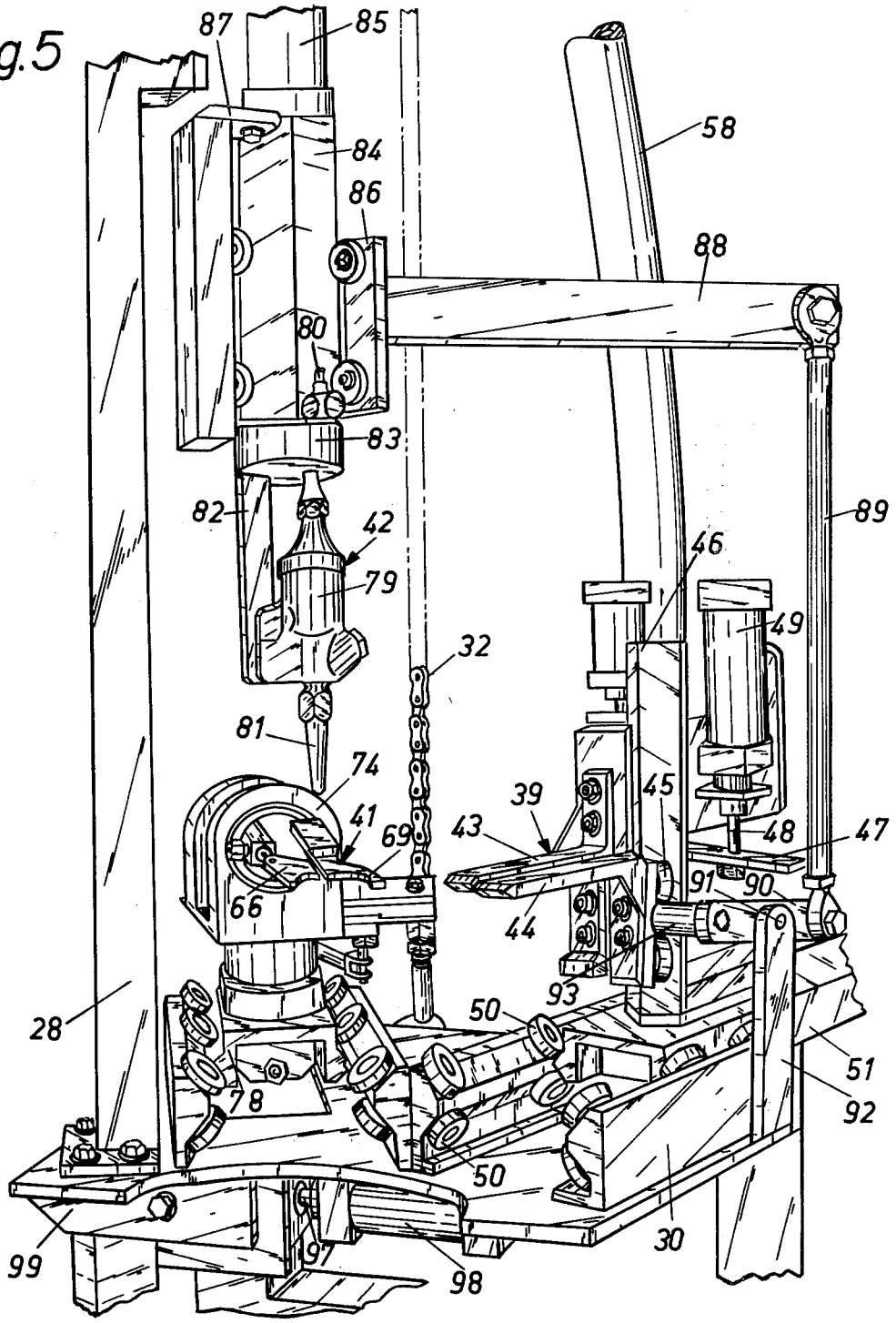
FIG. 5 is a perspective view which illustrates in closer detail a vertical view of the right-hand portion of the machine as seen from the machine interior and wherein some details are eliminated for more clarity.

The carriage 25 with the support frame 26 and the two machine stands 29, 30 are thereafter moved in over the concrete elements 2, 3. The machine stands 29, 30 are lowered by the motor 38 until the damping means 95 (FIG. 4) abut against the upper surface of the slab 3. The sensing and height setting device 39 (FIG. 5) is displaced together with its slide 51 by the cylinder 51*a*, whereby the leg sections 43, 44 engage in the gap 22 (FIG. 4). At the same time, the arm 47 abuts against the roller 93 on the lever 90, thereby displacing the holder 86 via the rod 89 and the arm 88 to a certain position of departure. By means of the piston-and-cylinder unit 48, 49 the leg section 44 is forced against the upper edge 102 of the coffer 2 and thus lifts the machine stands 29, 30 until the leg section 43 abuts against the lower face of the slab 3. The stands 29, 30 are now in their correct operative position and the clamping means 99 secures them in this position. Upon displacement of the leg section 44 downwards, the arm 47 was moved as well, said arm then swinging the lever 90 in the anti-clockwise direction as seen in FIGS. 4 and 5, whereby the holder 86 together with the spray gun 79 were forced to take the correct vertical position (which is important, as will appear from the following description).

In the downward movement of the leg section 44 is accompanied by corresponding movement of the stop abutment 62 which thus assumed a position at the correct vertical distance from the knife 53. The motor 61 and the rollers 59, 60 driven thereby feed the rod blank 58 downwards against the stop abutment 62 and the piston-and-cylinder unit 55, 56 displaces the knife 53 to the right in accordance with FIG. 7 so as to cut off the lower end (piece 101) from the rod blank 58.

Figure 6:
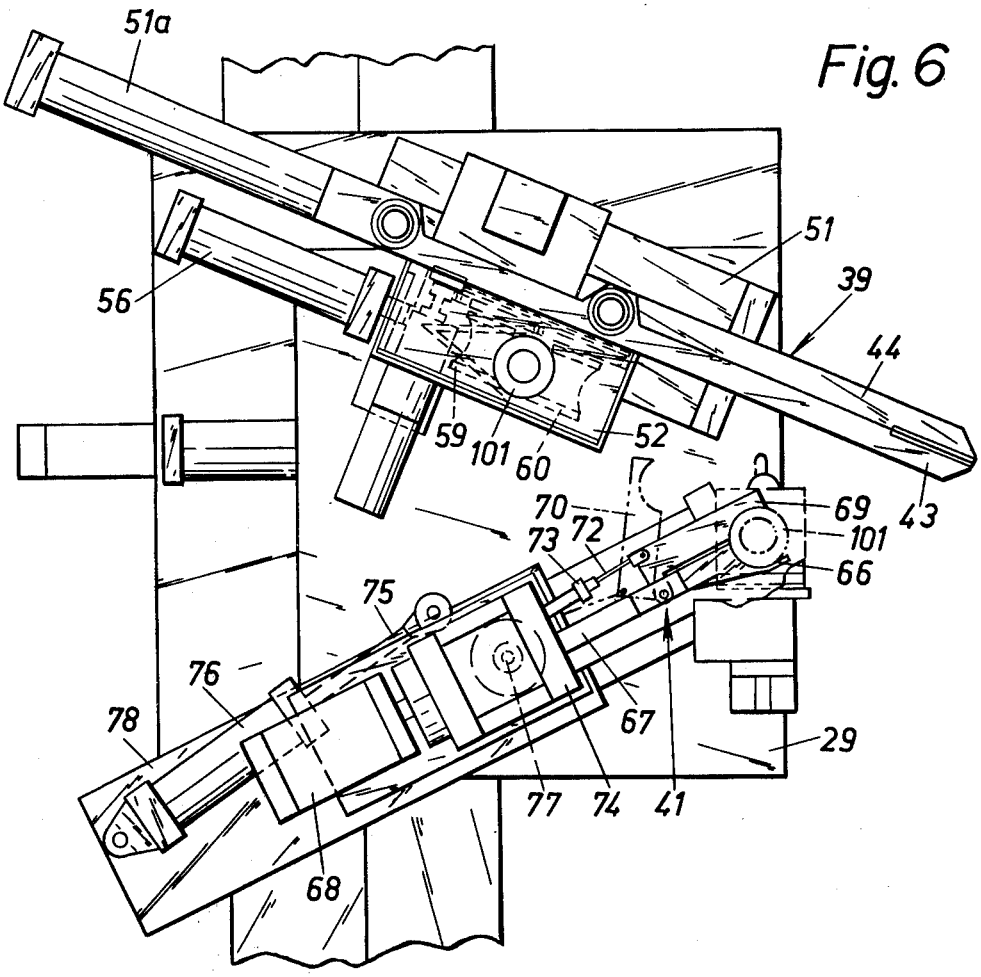
FIG. 6 is a plan view of the sensing device, the severing means and the gripping means of the machine, the latter means shown in its outer position.
Figure 11:
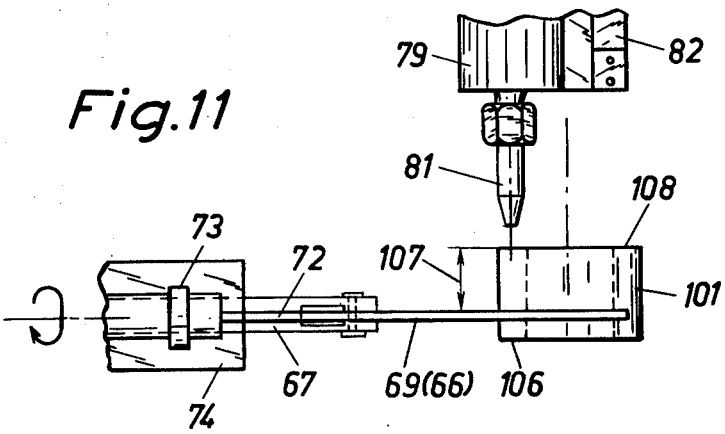
FIG. 11 is a similar view illustrating application of the adhesive to the opposite piece end surface.

The gripping device 41 is swung by the piston-and-cylinder unit 75, 76 from the outer position illustrated in FIG. 6 to the inner position illustrated in FIG. 7, whereby the claw 69 mounted on the arm 70 together with the claw 66 mounted on the arm 67 are made to grip the severed piece 101. The head 52 together with the guide 57 are lifted by the piston-and-cylinder unit 64, 65 to a sufficiently high level (FIG. 9) for the upper end of the severed piece 101 to go clear of the guide 57. While bringing along the piece 101, the gripping device swings back to its original position (the outer one in accordance with FIG. 6) below the spray gun 79.

While pressure is applied on the adhesive contained in the spray gun 79 the rotator 83 rotates the gun in such a manner as to effect spraying of the adhesive along a circular arc path on the upper surface of the resilient piece 101. Owing to the pre-setting effected by the arm 47, the lever 90, the rod 89, the arm 88 and the holder 86, the spray nozzle 81 will work at a suitable distance away from the resilient piece 101. The motor 68 turns the gripping means 41 about the longitudinal axis thereof over half a revolution with the result that the opposite end surface of the resilient piece 101 will be turned upwards. In the same manner as just described, this second end surface will also be coated with an adhesive. The gripping device 41 is thereafter turned back to its original position.

As most clearly appears from FIGS. 8 and 9 the gripping claws 66 and 69 seize the severed piece 101 at a distance 104 that is always the same relative to the knife 53 and for this reason it becomes easy to also keep a constant distance 105 (FIG. 10) relative to the spray gun 79 during application of the adhesive to the upper surface 106 of the severed piece 101. However, as the vertical position of the stop abutment 62 depends on the setting of the movable leg section 44 in vertical position and thus on the height of the gap 22, the distance 107 between the gripping claws 66, 69 and the lower end face 108 of the piece 101 will vary. Consequently, when the latter end surface 108, upon turning movement of the gripping arm 67 over half a turn about its own axis (see the position in FIG. 1), faces upwards, it is necessary that the spray nozzle 81 together with the spray gun 79, the holder 82, and the rotator 83 with the slide 84 are positioned at a correspondingly higher level, which is rendered possible by the abutment of the slide against the stop abutment means 87, which is achieved through the pre-setting of the holder arm 88 by means of the arm 47 pressing against the roller already upon attainment of the vertical adjustment of the entire machine stand 29, 30 effected by the means 39. As a result, the spray nozzle 81 will be positioned at the same distance from the severed piece 101 upon adhesive application of both the upper end surface 106 and the lower end surface 108.

The vertical level setting device 39 is returned by the cylinder 51*a* to the original position, i.e. the leg sections 43, 44 are withdrawn from the gap 22 (to the right according to FIG. 4). Instead, the gripping device 41 together with the resilient piece 101 retained by the claws 66, 69 are moved into the gap 22, wherein the arm 70 is swung to the side, thus releasing the piece 101 which, upon return movement of the gripping device to the original position thereof (FIG. 6), is left inside the gap 22.

Figure 3:
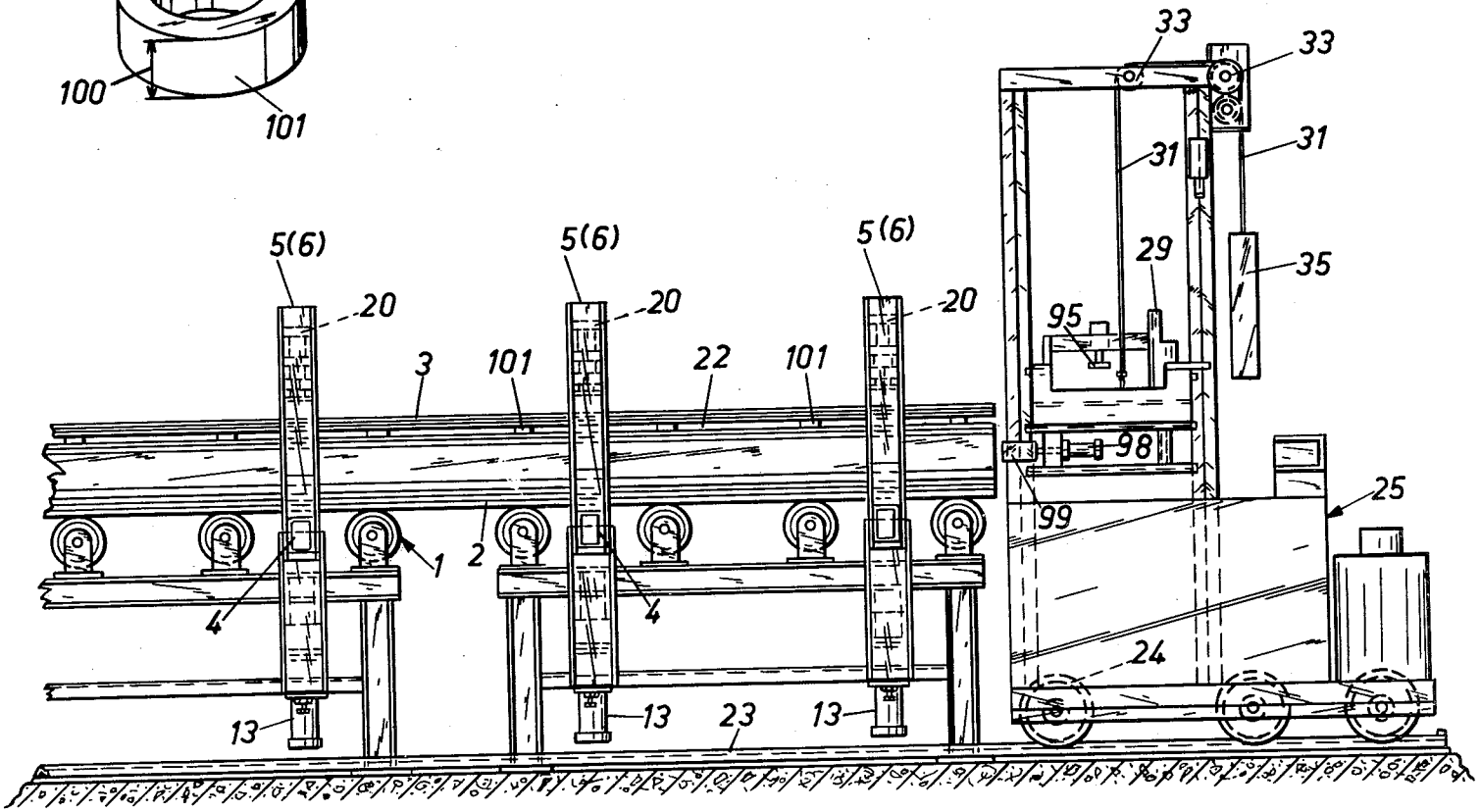
FIG. 3 is a side view of the machine in accordance with FIG. 1.
Figure 12:
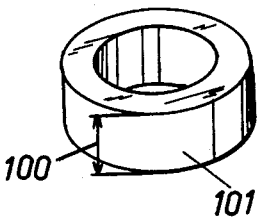
FIG. 12 is a perspective view of a severed resilient piece.

The carriage 25 together with the support frame 26 and the two machine stands 29, 30 are then displaced one step to the left, as seen in FIG. 3, e.g. over appr. 1 meter, at which point the process is repeated and two new resilient pieces 101 are deposited inside the gap 22, and so on. In order to make it possible for the machine to pass the levers 5, 6 the machine frames 29, 30 must be lifted by the motor 38 and thereafter again lowered into operative position (FIG. 4).

When the intended number of resilient pieces 101 have been positioned at their places in the gap 22, the slab 3 is lowered by the piston-and-cylinder unit 19, 20 into resting position on the resilient pieces 101, the latter, because of the presence of the adhesive thereon, interconnecting the slab 3 and the coffer 2. When the levers 5, 6 have been swung apart, the thus composed concrete beam is removed on the roller conveyor 1 and fresh concrete elements are advanced thereon in its place.

All the working stages described above are executed in sequence with the aid of a pressurized air system including valves and limit switches. As such systems are well known to the expert in the field they are not described herein, nor shown in the drawings.

The resilient pieces 101 provide good sound-insulation between the concrete slab 3 and the concrete coffer 2. The shape of the pieces 101 may vary within the scope of the invention. Instead of annular pieces 101 (see FIG. 12) solid pieces may be used.

In the aforegoing it has been suggested to apply an adhesive to the resilient pieces 101 on both the upper end surface 106 thereof and the lower end surface 108 thereof. However, it may be sufficient to provided only the lower end surface 108 with an adhesive.

The manually operated machine, illustrated in FIGS. 13 to 19, will be described in the following.

In a support frame 111, provided with a handle 110, is disposed a cylinder 112 into which may be inserted from above a rod-shaped blank 58' of rubber or similar resilient material. A piston 113 is axially displaceable inside the cylinder 112 and arranged to displace the rod-shaped blank 58' against a stop abutment 114. The latter is disposed on the lower end of a piston rod 115 which is axially displaceable in a cylinder 116 positioned in the extension of the cylinder 112 in its operative position. The cylinder 116 is mounted on an arm 117 which is pivotally mounted on a sleeve 118 for swinging motion in a horizontal plane and which may be retained in said operative position by blocking means 119. The arm may be swung laterally away from the upper open end of the cylinder 112, whereby the rod blank 58' may be pushed down the cylinder. The sleeve 118 forming together with the arm 117 a support frame for the cylinder 116 with the piston rod 115 and stop abutment 114, may be displaced in the vertical direction by a piston-and-cylinder unit 120, 121.

The vertical level setting device of the machine comprises two leg sections 43, 44 which may be introduced into the gap 22 formed between the two concrete elements 2, 3. Leg section 43 is arranged on the sleeve 118 whereas leg section 44 is provided on the support frame 111.

The severing device consists of a plate-like knife 53 having a V-shaped edge 54 and arranged for movement by a piston-and-cylinder unit 55, 56. The knife 53 may be moved past the upper end of the cylinder 112.

Push means 122 are provided to operate a number of valves 123, 124 to supply pressurized medium, such as pressurized air, to the cylinders 56, 112, 116, and 121.

Reference numeral 125 designates a relief valve incorporated in the line system and at 126 the line system is imagined connected to the source of pressurized air (not shown). Remaining details of the line system have not been given any designation as the lay-out of lines and the coupling of the cylinders 56, 112, 116, and 121 of the apparatus thereto involves no difficulties to the expert in the field.

Figure 16:
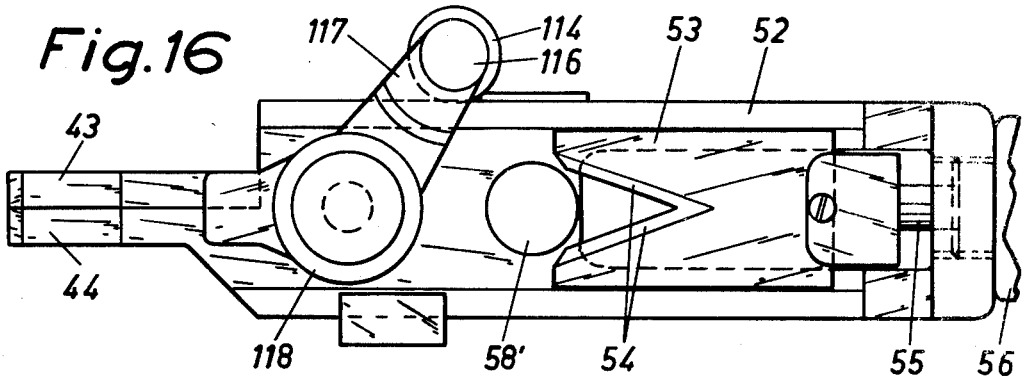
FIG. 16 illustrates on an even larger scale a plan view of the machine in accordance with FIG. 14, the machine position being that of insertion of the rod-shaped blank into the cylinder.
Figure 17:
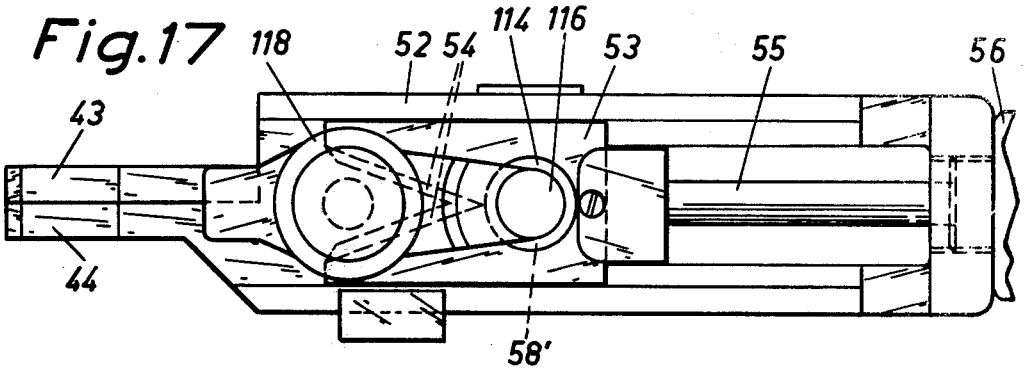
FIG. 17 is a similar view of the machine, illustrating the severing means after completion of the cutting-off of the rod-shaped blank.
Figure 18:
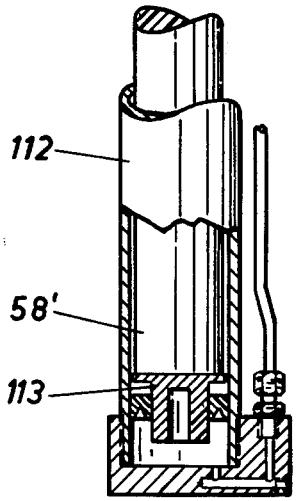
FIG. 18 illustrates on an enlarged scale the lower end of the cylinder in accordance with FIG. 13.

After application of pressurized air, the machine is to be "loaded", whereby the arm 113 together with the stop abutment 114 are first swung laterally (see FIG. 16). The push means 122 is then pushed home, whereby the knife 53 is displaced against the action of a spring (not shown) to its rear position (illustrated in FIG. 16) exposing the upper end of the cylinder 112. The rod blank 58' may now be pushed down into the cylinder 112. The arm 117 with the stop abutment 114 is swung back to operative position, illustrated in FIG. 17, and the push means is released, when the knife 53 is returned to its forward position. The machine is now in operative condition.

The measuring leg sections 43, 44 are introduced into the gap 22. When the push means 122 is again pushed completely home, pressurized medium is introduced into the cylinders 116 and 121. The measuring leg sections 43, 44 are then forced apart while at the same time the stop abutment 114 is moved to its lower position. The distance 127 between the stop abutment 114 and the lower face of the leg section 44 then becomes approximately equal to the distance 128 between the surfaces of the leg sections that face away from one another, i.e. the height of the gap 22. In said bottom position of the push means 122 (the right-hand position in accordance with FIG. 14) pressurized medium is introduced also into the cylinder 56, the result being that the knife is carried to its rear position (FIG. 16) against the action of the above-mentioned spring, not illustrated. Finally, pressurized medium is introduced into the cylinder 112 at the lower end thereof via the pressure relief valve 25, and as a consequence the piston 113 pushes the rod blank 58' upwards until the upper end thereof abuts against the stop abutment 114. The push means 122 is now released over such a distance (see the intermediate position illustrated in FIG.

Figure 19:
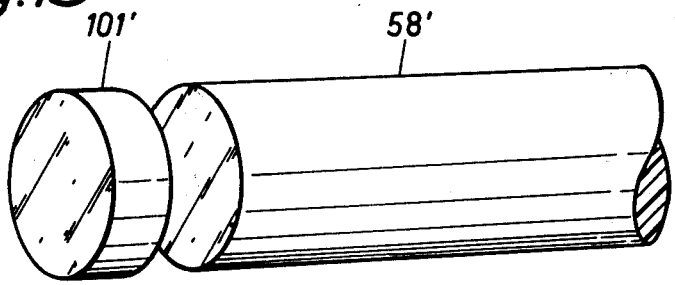
FIG. 19 illustrates in a perspective view the rod-shaped blank together with a piece cut away therefrom.
Figure 14:
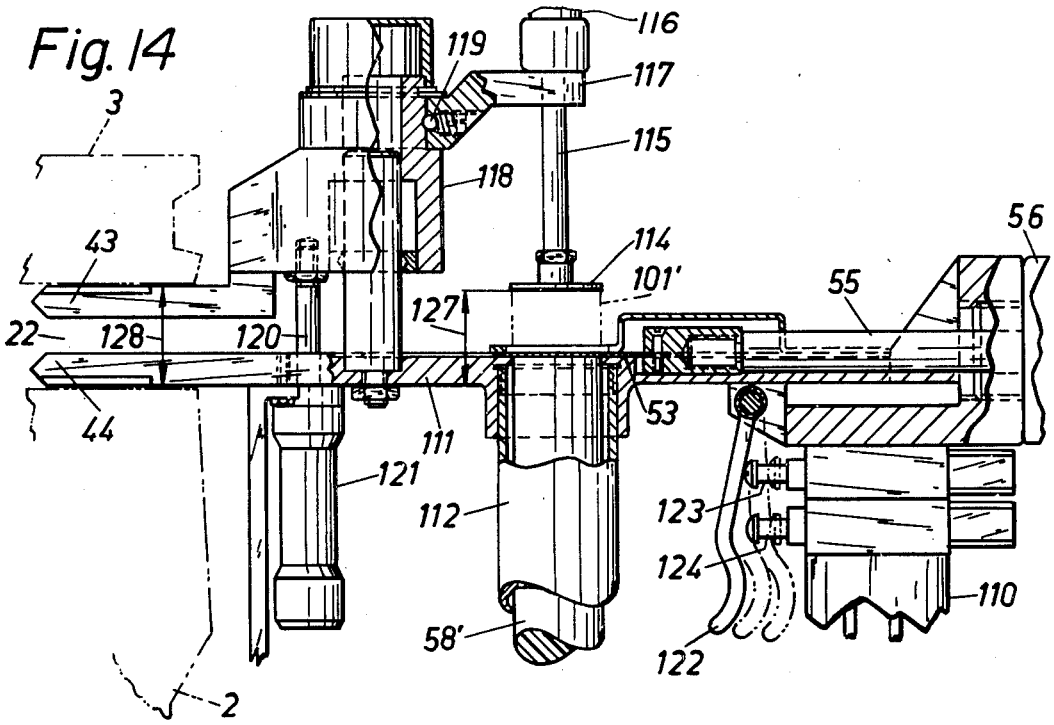
FIG. 14 illustrates on an enlarged scale and partly in vertical section the upper part of this machine during the measuring operation.
Figure 15:
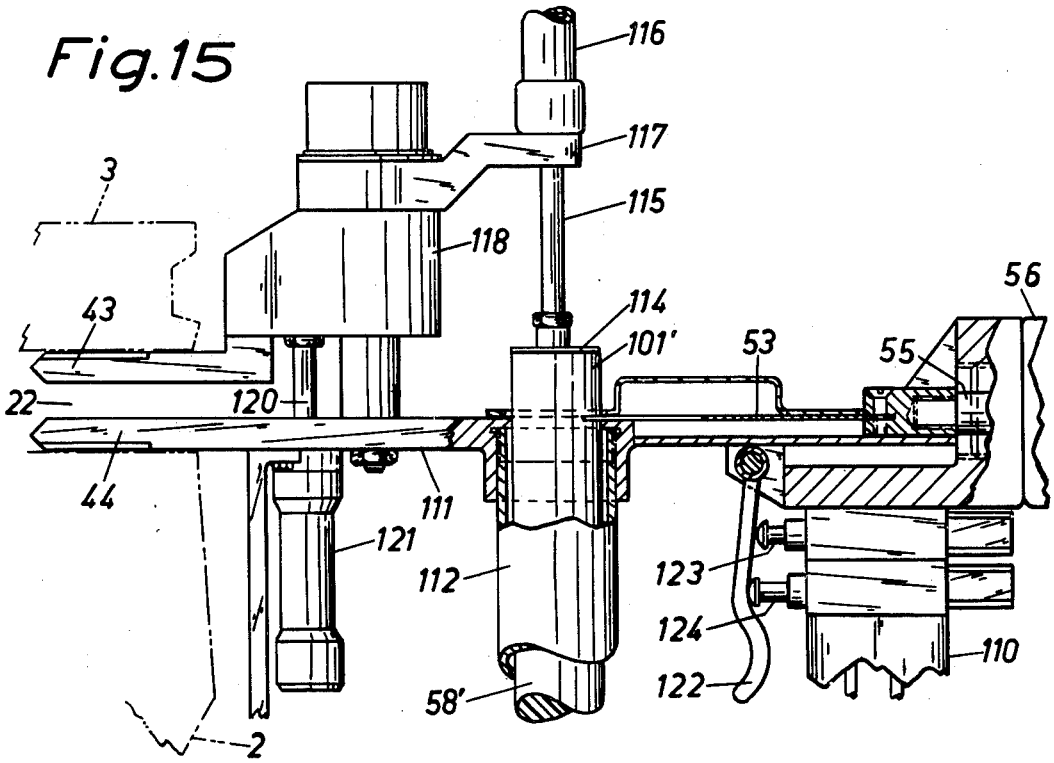
FIG. 15 is a similar view with the rod-shaped blank in position for severing.

14) that the valve 124 assumes its forward (left) position. The knife 53 is then displaced by said spring to its forward (left) position, and as a result the piece designated 101' in FIGS. 14 and 19 is severed from the rod blank 58'. This piece (block) 101' is coated with an adhesive and after advancement of the apparatus forwards over one interval along the concrete beam, it is introduced into the gap 22 at the place immediately before occupied by the leg sections 44, 43.

In this manner one resilient block 101' after the other is inserted into the gap 22 at equal intervals along the entire beam, whereupon the slab 3 is lowered and thereafter supported by all the insulating blocks.

Owing to the pressure relief valve 125 is ensured that the displacement of the piston 113 in the upward directions is retarded so as to allow the stop abutment 114 to safely arrive at its lower operative position before the upper end of the rod blank 58' has reached this position. In addition is ensured that the force of the upward pressure of the piston does not exceed the force by which the stop abutment 114 is compelled to its lower operative position; otherwise the severed pieces 101' naturally would not have been given the thickness corresponding to the height of the gap 22 at the respective measuring points.

The line system incorporated into the apparatus and the valves therefor may be varied in many ways.

Figure 13:
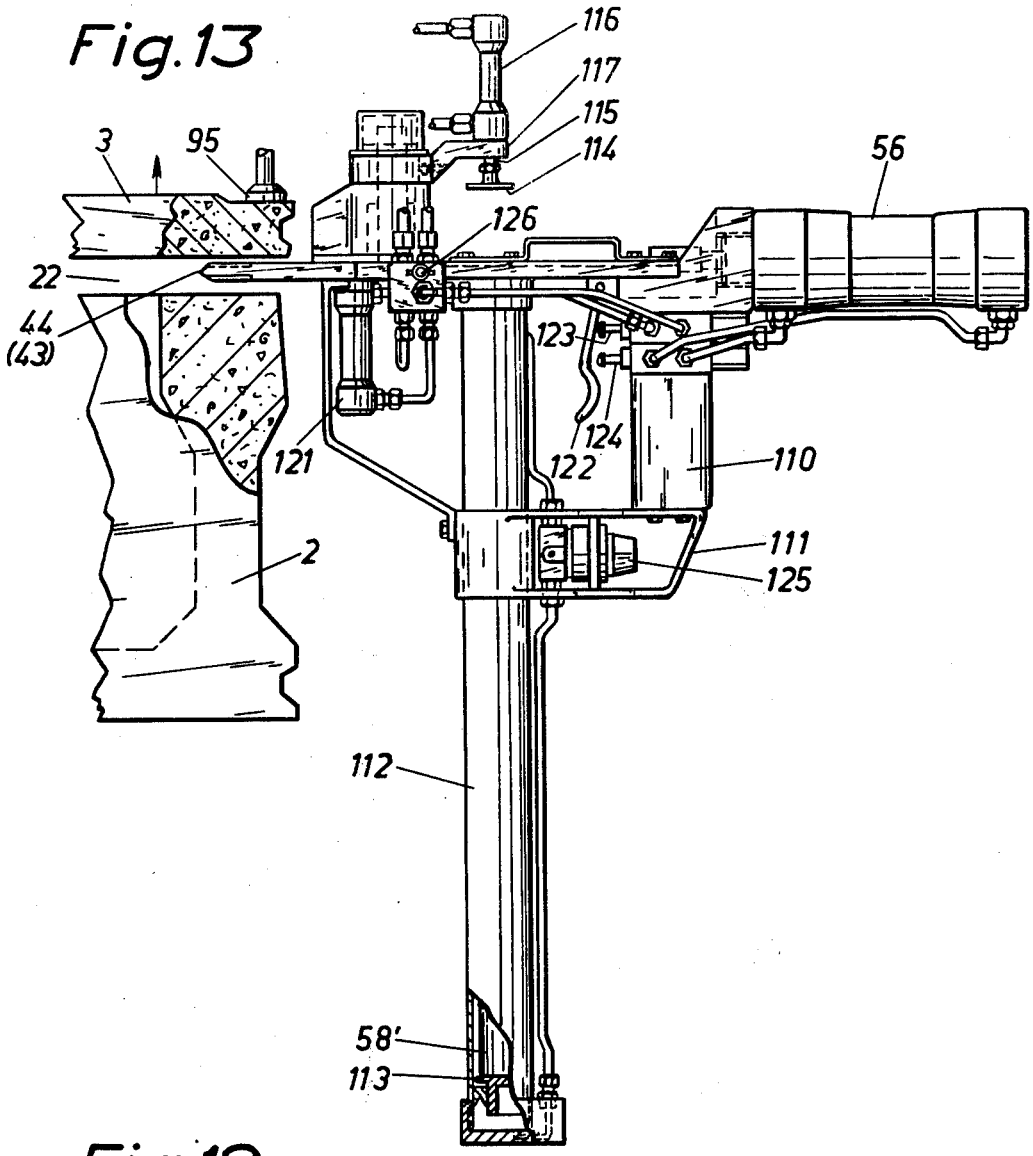
FIG. 13 is a side view of a pneumatically operative machine in accordance with the invention together with a partly broken end view of a concrete beam to be provided with sound-insulating material.

The embodiments as shown and described are to be regarded as examples only and the various details of the machines may be constructively altered in a variety of ways within the scope of the invention. The spray gun 79 may be replaced by some other glue applicator, e.g. in the form of a glue applicating roller supplied with glue continuously from a glue container. The machine may be used to apply resilient pieces 101 between other types of concrete elements than those illustrated herein consisting of a coffer and a covering slab. In the aforegoing the cylinder 56 has been described as a single-acting cylinder, its piston 55 being displaced by the pressurized medium in one direction and by means of a spring in the opposite one. However, the cylinder 56 may also be double-acting, i.e. its piston may be displaced by pressurized medium in both directions, as indicated in FIG. 13 (see the connecting points of the lines at the two ends of the cylinder).

What I claim is:

1. In an improved machine comprising a bed supporting a lower element and an upper element resting thereon, a number of lifting means, abutment means cooperating with said lifting means, a supply of resilient sound-insulating material, said lifting means arranged to raise said upper element into contact with said abutment means so as to form between said upper and said lower elements a gap having a height of a predetermined value, said predetermind value exceeding the height of one layer of said sound-insulating resilient material to be introduced into said gap, the improvement comprising a stand vertically movable adjacent said elements, said stand including a setting device insertable into said gap to sense the height thereof and adapted to set said stand vertically in dependence on the height of said gap, a stop abutment, said stop abutment being associated with said setting device to position said stop abutment dependent upon the position of said setting device, a feed device for feeding from said supply a blank of said resilient material against said stop abutment, and a device for severing a piece from one end of said blank, the height of said piece becoming dependent on the height of said gap.

2. A machine in accordance with claim 1, comprising two leg sections incorporated in said sensing and vertical level setting device to be inserted between the upper and lower elements, one of said leg sections rigidly connected to said stand whereas the second one of said leg sections is movable vertically relative to said stand, a power means provided on said stand to perform said vertical movement of said second leg section.

3. A machine as claimed in claim 1, comprising a carriage movable relative to said elements, said stand being supported by said carriage and said vertical movement of said stand being relative to said carriage, a device for gripping said severed piece and moving it outwards towards said gap, and a device for applying an adhesive to said severed piece on at least the downwardly facing surface of said piece, said gripping device further arranged to insert said resilient piece, thus treated with an adhesive, into said gap.

4. A machine as claimed in claim 3, wherein said adhesive applicating device comprises a vertically operating spray gun, said spray gun arranged for movement in such a manner as to allow the nozzle thereof to describe a circular arc about an axis parallel to said vertical direction during the application of adhesive to the severed piece.

5. A machine in accordance with claim 3, comprising two leg sections incorporated in said sensing and vertical level setting device to be inserted between the upper and lower elements, one of said leg sections rigidly connected to said stand whereas the second one of said leg sections is movable vertically relative to said stand, a power means provided on said stand to perform said vertical movement of said second leg section.

6. A machine as claimed in claim 5, comprising a slide vertically movable on said stand, said adhesive applicating device mounted on said slide, a lever mechanism for raising said slide upon pivotal movement of said lever mechanism and an actuating means to pivot said lever mechanism, an abutment arm on said second movable leg section adapted to operate said actuating means, said actuating means arranged to be moved out of the path of movement of said abutment arm following introduction of said sensing and vertical level setting device into said gap.

7. A machine in accordance with claim 6, wherein the stop abutment is provided on said vertically movable second leg section.

8. A machine as claimed in claim 7, comprising a guide means positioned beneath said severing device for guiding the movement of said severed piece, said severing device together with said guide means arranged to be raised (e.g. through swinging motion) from said stop abutment.

9. A machine as claimed in claim 3, wherein said gripping device is arranged for turning movement over half a revolution forwards and backwards about its horizontal longitudinal axis.

10. A machine as claimed in claim 9, wherein said gripping device is also arranged for swinging movement about a vertical axis from an outer position to an inner position in order to seize a severed resilient piece.

11. A machine as claimed in claim 1, wherein said blank is in the shape of a hollow tube, the resulting pieces, when severed, thus being annular.

12. A machine as claimed in claim 1, wherein said blank is solid.

13. An improved machine for inserting a noise insulating member of resilient material, such as rubber, between a lower element, and an upper element comprising a stand, a support frame, said stand displaceable upwards and downwards on said support frame, said stand supporting a device, said device insertable from the side into a gap formed intermediate said upper and lower elements to sense the height of said gap and to set said stand in vertical position, a stop abutment provided on said stand so as to be vertically dependent on the height of said gap, a device for advancement of a rod-shaped blank of said sound-insulating member of resilient material against said stop abutment, and a device for severing a piece from one end of said rod blank, the height of said piece becoming dependent on the height of said gap, the improvement comprising said support frame supporting said setting device on said stand, a vertical cylinder on said support frame to hold said rod-shaped blank, the upper end of said cylinder positioned below said stop abutment of said stand, and an actuating piston arranged on said cylinder to force said rod-shaped blank up against said stop abutment.

14. A machine as claimed in claim 13, wherein said stop abutment is arranged to be swung laterally away from the upper end of said cylinder to facilitate introduction of said rod-shaped blank into said cylinder from above.

15. A machine as claimed in claim 13, comprising a knife on said support frame for cutting off said rod-shaped blank, said knife arranged for horizontal movement past the upper end of said cylinder.

* * * * *